US008348415B2

(12) United States Patent
Nagata

(10) Patent No.: US 8,348,415 B2
(45) Date of Patent: Jan. 8, 2013

(54) RECORDING PAPER TRANSPORTATION PATH STRUCTURE AND PRINTER

(75) Inventor: Norio Nagata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 275 days.

(21) Appl. No.: 12/715,354

(22) Filed: Mar. 1, 2010

(65) Prior Publication Data

US 2010/0220167 A1 Sep. 2, 2010

(30) Foreign Application Priority Data

Mar. 2, 2009 (JP) ..... 2009-047668

(51) Int. Cl.
*B41J 2/01* (2006.01)

(52) U.S. Cl. ..... 347/104; 347/102; 347/215; 347/217; 347/222; 358/296; 358/496; 400/120.01; 400/120.02; 400/120.16

(58) Field of Classification Search ..... None
See application file for complete search history.

(56) References Cited

U.S. PATENT DOCUMENTS

| | | | | |
|---|---|---|---|---|
| 5,393,151 | A * | 2/1995 | Martin et al. | 400/642 |
| 5,820,283 | A * | 10/1998 | Sunada et al. | 400/642 |
| 6,113,289 | A | 9/2000 | Saito et al. | |
| 6,183,152 | B1 | 2/2001 | Kumai et al. | |
| 6,789,890 | B2 * | 9/2004 | Bruhn et al. | 347/104 |
| 6,840,617 | B2 * | 1/2005 | Crosby et al. | 347/104 |
| 2003/0218783 | A1 * | 11/2003 | Endo et al. | 358/474 |
| 2005/0168557 | A1 * | 8/2005 | Ohyama | 347/104 |
| 2007/0291096 | A1 * | 12/2007 | Toyoshima | 347/104 |

FOREIGN PATENT DOCUMENTS

| | | | |
|---|---|---|---|
| JP | 07-251997 | A | 10/1995 |
| JP | 11-139625 | A | 5/1999 |
| JP | 11-245457 | A | 9/1999 |
| JP | 2000-072303 | A | 3/2000 |
| JP | 2001-212946 | A | 8/2001 |
| JP | 2002-019204 | A | 1/2002 |
| JP | 2002-067407 | A | 3/2002 |
| JP | 2002-120419 | A | 4/2002 |
| JP | 3864791 | B2 | 1/2007 |

* cited by examiner

*Primary Examiner* — Matthew Luu
*Assistant Examiner* — John P Zimmermann
(74) *Attorney, Agent, or Firm* — Kilpatrick Townsend & Stockton LLP

(57) ABSTRACT

A recording paper transportation path structure suppresses sagging of the recording paper fed from the nipping part of a pair of rollers to the platen surface of a vacuum platen, and can prevent a drop in paper feed precision. In a roll paper printer 1, the recording paper fed through the nipping part 52 of a paper feed roller 22 and a paper pressure roller 23 is fed along the contact plane P2 of the outside surface of the rollers 22 and 23 toward the platen surface 8*a* of the vacuum platen 8 at a slightly lower position. An inclined surface part 12*b* that slopes along the contact plane P2, an up-lifting surface part 12*c* that slopes down, and a protruding surface part 12*d* are formed contiguously to the upstream side at the upstream end part 8*b* of the platen surface 8*a*. Because the part of the recording medium 10 fed from the nipping part 52 is supported and guided by these parts, the paper is guided to the horizontal surface 12*a* of the platen surface 8*a* without drooping down, and a drop in paper feed precision and paper jams caused by the recording paper sagging can be avoided.

7 Claims, 7 Drawing Sheets

RECORDING PAPER TRANSPORTATION PATH STRUCTURE AND PRINTER

This application claims priority to Japanese Patent Application No. 2009-047668, filed Mar. 2, 2009, the entirety of which is incorporated by reference herein.

BACKGROUND

1. Technical Field

The present invention relates to a printer that has a vacuum platen that holds the recording paper to the platen surface defining the printing position while the paper is conveyed, and relates more particularly to a recording paper transportation path structure that guides the recording paper delivered to the platen surface through the nipping part of a paper feed roller and a paper pressure roller.

2. Related Art

Holding the recording paper tight to the platen surface that defines the printing position in a printer, such as an inkjet printer, and assuring a precise platen gap is important as a means of assuring print quality. In order to convey while holding the recording paper to the platen surface, a vacuum platen that pulls the recording paper to the platen surface by means of air suction while the paper is conveyed is used. More particularly, because continuous recording paper such as roll paper and fanfold paper typically has a curl or crease, a vacuum platen is preferably used to forcibly hold the recording paper flat. Printers having a vacuum platen are taught in Japanese Unexamined Patent Appl. Pub. JP-A-2001-212946 and Japan Patent No. 3864791, for example.

If the part of the recording paper that is delivered from the nipping part of the paper feed roller and paper pressure roller to the platen surface of the vacuum platen is fed in a direction lifting away from the platen surface, a gap is produced between the recording paper and the platen surface, a vacuum condition cannot be produced by air suction therebetween, and it may not be possible to pull the recording paper to the platen surface. It is therefore preferable to direct the paper feed direction of the recording paper that is fed from the nipping part between the rollers to the platen surface at an angle causing the paper to approach the platen surface instead of parallel to the platen surface, and thereby feed the part of the recording paper advanced from the nipping part so that the paper is pushed to the platen surface.

However, problems such as described below can occur when this type of recording paper transportation path structure is used.

More specifically, as shown in FIG. 7, in order to feed the recording paper 100 in a direction pushing it toward the platen surface 102 of the vacuum platen 101, a step A must be provided between the nipping part 105 of the rollers 103 and 104 and the platen surface 102. If the nipping part 105 and the platen surface 102 are at the same height, the recording paper 100 advanced from the nipping part 105 is guided from the edge 102*a* of the platen surface 102 while being supported by the platen surface 102. However, when there is a step A, the part of the recording paper 100 fed from the platen surface 102 contacts the platen surface at a position on the downstream side in the transportation direction from the edge of the platen surface as indicated by dot-dash line B.

When such a step is provided, the distance until the recording paper 100 fed from the nipping part 105 is supported by the platen surface 102 increases, and the part of the recording paper 100 passed from the nipping part 105 to the platen surface 102 is conveyed with a sag imparted thereto by the suction of the vacuum platen 101.

As a result, when a curled or creased part of the recording paper 100 is advanced from the nipping part 105, it sags greatly into the gap 110 between the nipping part 105 and the edge 102*a*. If the recording paper 100 sags greatly, the part of the recording paper 100 conveyed over the platen surface 102 becomes shorter than the length of the part of the recording paper 100 fed from the nipping part 105 by the amount of this sag. As a result, the dot pitch of the inkjet head may vary and print quality may drop because not enough paper is advanced and there is a drop in the paper feed precision.

Particularly when using recording paper such as fanfold paper, paper stiffness differs greatly at different parts along the paper length. For example, because fanfold paper is particularly weak at the folds, when the folded part is passed from the nipping part to the platen surface, the folded part bends and sags deeply into the gap 110 between the nipping part and the platen surface, may become stuck between the platen surface 102 and the roller 103, and a paper jam may result.

SUMMARY

A recording paper transportation path structure and a printer having the recording paper transportation path structure according to the present invention suppress sagging of the recording paper fed from the nipping part to the platen surface of the vacuum platen, and prevent a drop in paper feed precision.

A first aspect of the invention is a recording paper transportation path structure that feeds recording paper through the nipping part of a pair of rollers to the platen surface of a vacuum platen disposed opposite a print head, wherein the rollers are disposed so that the nipping part is positioned on a contact plane that inclines to the platen surface side in the recording paper transportation direction relative to the horizontal surface of the platen surface, and a line segment connecting the centers of said pair of rollers is inclined to the platen side; a guide surface that guides the recording paper fed from the nipping part is formed to an end part of the platen surface on the nipping part side; and the guide surface is a guide surface of a height not protruding from the contact plane.

The recording paper is fed in the direction of a contact plane of the outside circumference surface of the rollers through the nipping part of the rollers. More specifically, the part of the recording paper fed at a slope to the platen surface is conveyed while being pushed to the platen surface. In addition, the part of the recording paper advanced from the nipping part first rides onto the guide surface protruding from the platen surface, and is then guided while supported by the guide surface. As a result, sagging of the recording paper between the nipping part and the platen surface can be suppressed. In addition, because the guide surface is formed so that it does not protrude from the contact plane that defines the feed direction of the recording paper, the guide surface does not interfere with conveying the recording paper.

Preferably, the guide surface has an inclined surface part with an inclination angle following the contact plane. This aspect of the invention can reliably prevent the recording paper from sagging because the feed direction of the recording paper advanced from the nipping part and the direction of the inclined surface part of the guide surface are the same.

Yet further preferably, the guide surface has an up-lifting surface part that is contiguous to the inclined surface part and slopes to the platen surface side with proximity to the nipping part side.

When the part of the recording paper fed from the nipping part is curled or folded, said part is lifted up by the up-lifting surface part towards the inclined surface part on the downstream side, and the recording paper can therefore be conveyed smoothly.

Yet further preferably, a protruding surface part that protrudes to the nipping part side more than the end of the platen on the nipping part side is formed contiguously to the up-lifting surface part.

Because the gap between the vacuum platen and the rollers is narrowed by forming a protruding surface part, paper jams resulting from the recording paper becoming stuck in this part can be prevented.

A configuration in which the platen surface is defined by the top surfaces of a plurality of ribs extending in the paper transportation direction can be used as the vacuum platen. In this aspect of the invention the top surfaces of the ribs can define the platen surface, a protruding rib part that protrudes to the nipping part side more than the end of the platen can be formed, and the protruding surface part can be defined by the top surfaces of the protruding rib parts.

The platen surface is generally a horizontal surface that faces up, and the pair of rollers are disposed horizontally and pressed together vertically.

Another aspect of the invention is a printer having the recording paper transportation path structure described above. More particularly, the foregoing recording paper transportation path structure is used in an inkjet printer in which the print head is an inkjet head, and the vacuum platen opposes the ink nozzle surface of the inkjet head.

Effect of the Invention

With the recording paper transportation path structure according to the invention, the part of recording paper fed from the nipping part in a direction pushed against the platen surface is supported and guided by a guide surface formed at the end part of the platen surface on the side toward the nipping part of the rollers. Sagging of the recording paper that occurs in the part passed from the nipping part to the platen surface can therefore be suppressed, and a drop in paper feed precision and paper jams caused by the recording paper sagging can be prevented.

In addition, because a loss of paper feed precision and paper jams do not occur in the recording paper passed from the nipping part of a pair of rollers to the platen surface in an inkjet printer having this recording paper transportation path structure, the printing operation can proceed efficiently without a drop in print quality.

Other objects and attainments together with a fuller understanding of the invention will become apparent and appreciated by referring to the following description and claims taken in conjunction with the accompanying drawings.

DESCRIPTION OF EXEMPLARY EMBODIMENTS

A printer having a recording paper transportation path structure according to a preferred embodiment of the present invention is described below with reference to the accompanying figures.

General Configuration

Figure 1:
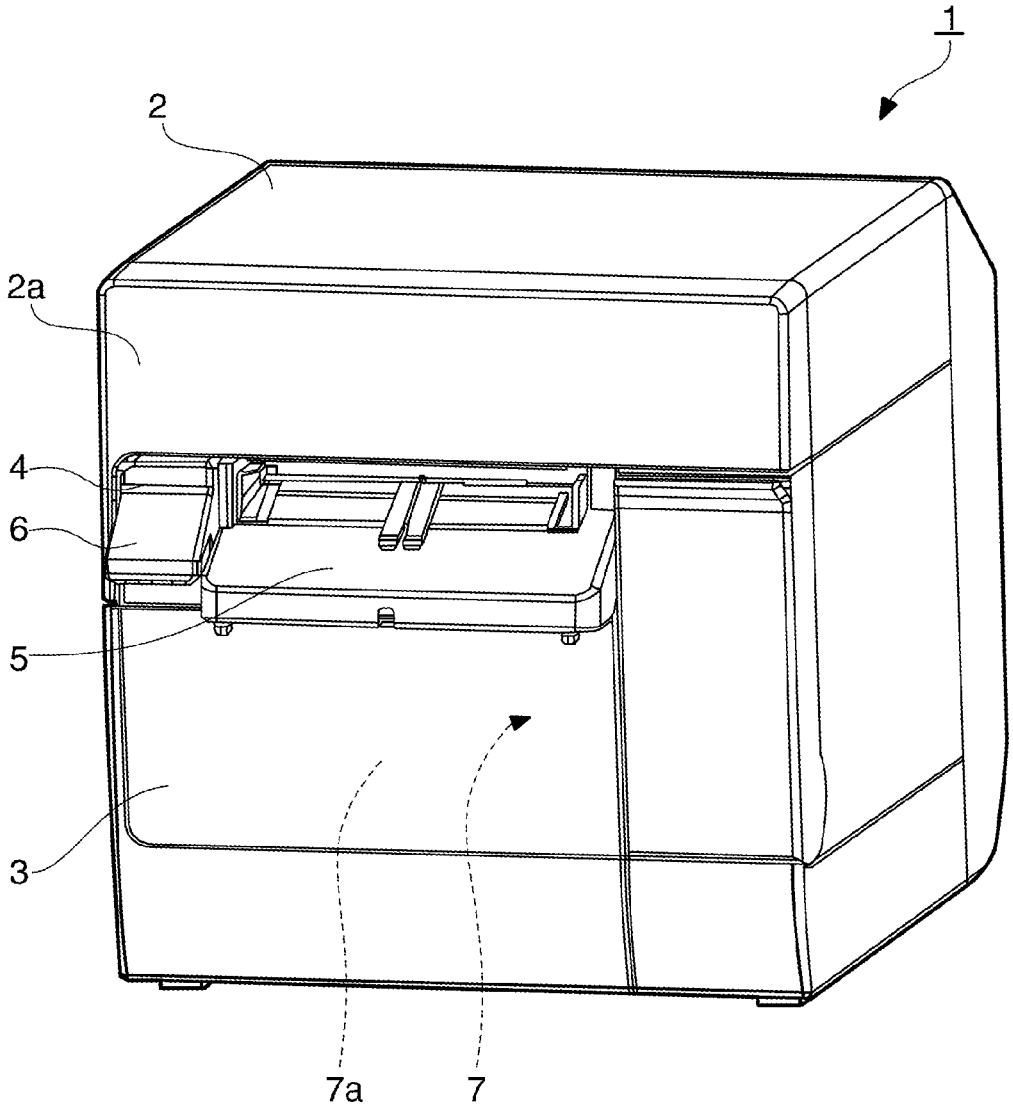
FIG. 1 is an external oblique view of a roll paper printer according to a preferred embodiment of the invention.
Figure 2:
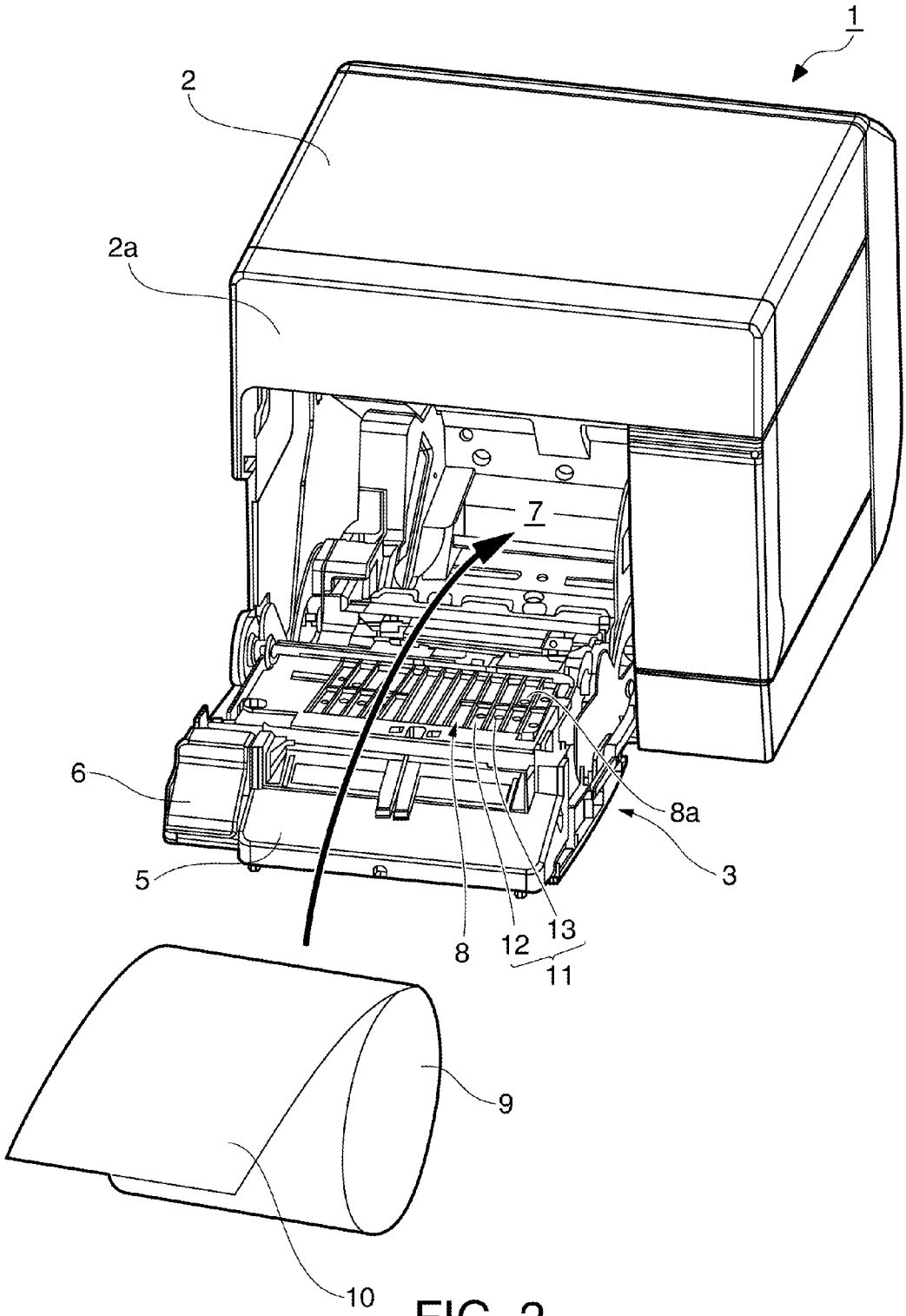
FIG. 2 is an external oblique view of the roll paper printer with the access cover open.

FIG. 1 is an external oblique view of a roll paper printer according to a first embodiment of the invention. FIG. 2 is an external oblique view of the printer with the cover completely open.

The roll paper printer 1 has a rectangular box-like body 2 and an access cover 3 that opens and closes and is disposed to the front of the body 2. A paper exit 4 of a specific width is formed at the front of the outside case 2*a* of the printer body 2. An exit guide 5 projects to the front from the bottom of the paper exit 4, and a cover opening/closing lever 6 is disposed beside the exit guide 5. A rectangular opening 7*a* for loading and removing roll paper in the roll paper compartment rendered inside the printer case 2 is formed in the outside case 2*a* below the exit guide 5 and cover opening/closing lever 6. This opening 7*a* is closed by the access cover 3.

Operating the cover opening lever 6 releases the lock holding the access cover 3 closed. When the lock is released and the exit guide 5 disposed to the access cover 3 is pulled forward, the access cover 3 pivots at the bottom end thereof and opens forward to a substantially horizontal position as shown in FIG. 2. Opening the access cover 3 opens the roll paper compartment 7, and the vacuum platen 8 that defines the printing position moves with the access cover 3, opening the recording medium transportation path from the roll paper compartment 7 to the paper exit 4. This enables easily loading or replacing the roll paper 9 from the front of the printer.

A vacuum unit 11 for holding a continuous recording medium 10 delivered from the roll paper 9 is formed in the platen surface 8*a* of the vacuum platen 8. The vacuum unit 11 has a plurality of channel-shaped vacuum areas separated by a plurality of longitudinal ribs 12, and intake holes 13 formed in the bottoms of the vacuum areas.

Internal Configuration

Figure 3:
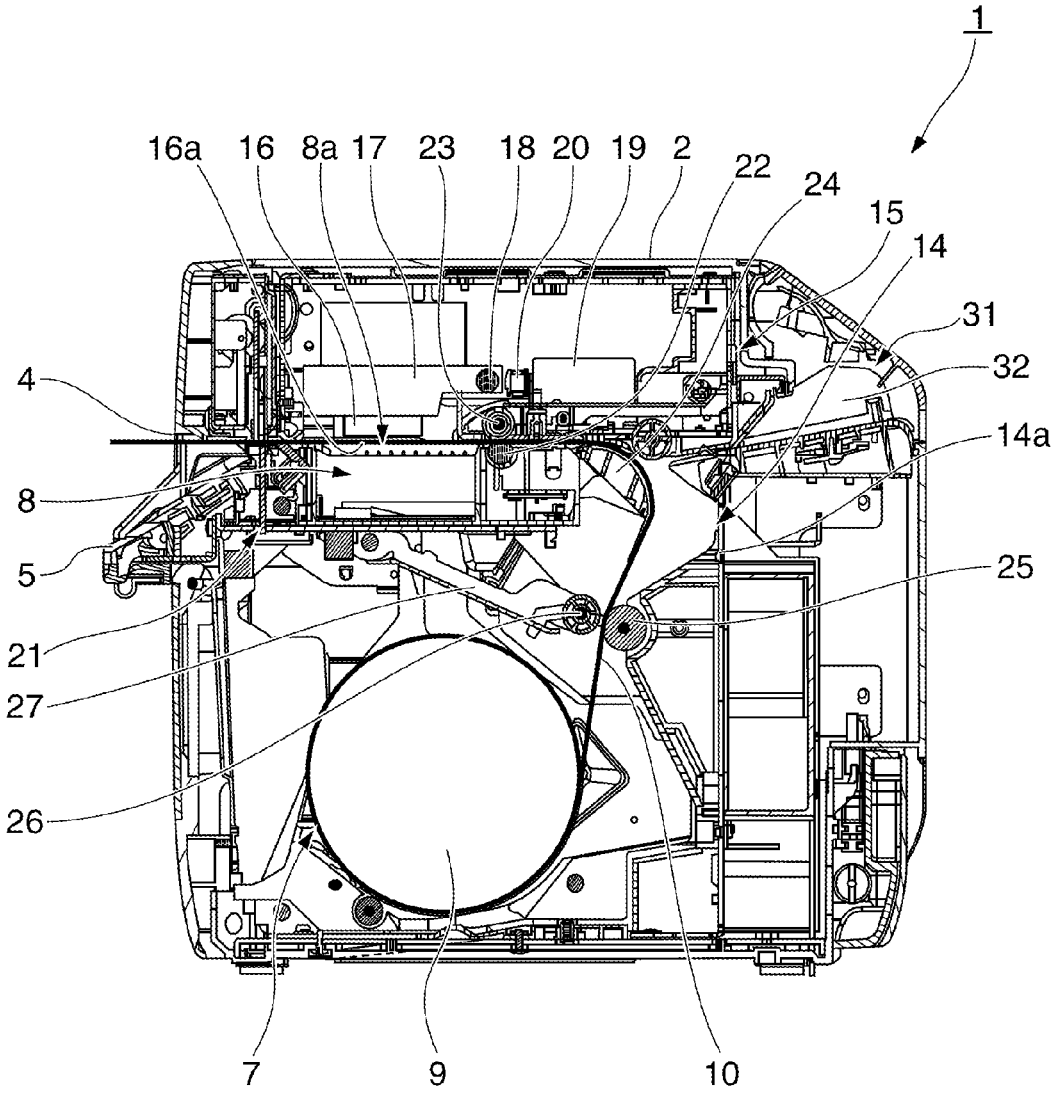
FIG. 3 is a schematic vertical section view of the roll paper printer.

FIG. 3 is a schematic vertical section view showing the internal configuration of the roll paper printer 1, and shows the roll paper compartment 7 from the right side of the printer.

A roll paper compartment 7 is formed in the center between the side walls of the printer frame 14 inside the roll paper printer 1. Roll paper 9 is stored facing the width of the printer in the roll paper compartment 7 so that it can roll on its side.

A head unit frame 15 is disposed horizontally at the top of the printer frame 14 above the roll paper compartment 7. Disposed to the head unit frame 15 are a carriage 17 that carries an inkjet head 16, and a carriage guide shaft 18 that guides movement of the carriage 17 widthwise to the printer. The inkjet head 16 is mounted on the carriage 17 with the ink nozzle surface 16*a* facing down. The carriage guide shaft 18 extends horizontally widthwise to the printer. A carriage transportation mechanism including a carriage motor 19 and timing belt 20 for moving the carriage 17 bidirectionally along the carriage guide shaft 18 is also disposed to the head unit frame 15.

A platen frame 21 extending horizontally in the front-back direction of the printer is disposed below the inkjet head 16. A vacuum platen 8 is disposed horizontally widthwise to the printer on the platen frame 21. The vacuum platen 8 defines the printing position of the inkjet head 16 at a position opposite the inkjet head 16 with a specific gap therebetween. A centrifugal fan 30 for pulling air through the vacuum unit 11 of the vacuum platen 8 is disposed on the back side of the back panel portion 14*a* of the printer frame 14 at the back of the roll paper compartment 7.

A paper feed roller 22 extends horizontally widthwise to the printer behind the vacuum platen 8. A paper pressure roller 23 of a specific width is pressed with specific pressure to the paper feed roller 22. The paper feed roller 22 is driven rotationally by a paper feed motor not shown that is mounted on the printer frame 14.

A tension guide 24 that curves down is attached at the back end of the platen frame 21. The recording medium 10 delivered from the roll paper 9 loaded in the roll paper compartment 7 travels diagonally upward and curves around the tension guide 24, and is then conveyed through a paper transportation path that extends horizontally to the paper exit 4.

A delivery roller 25 is disposed horizontally widthwise to the printer below the tension guide 24. The delivery roller 25 delivers the recording medium 10 from the roll paper compartment 7, and is located upstream from the tension guide 24 on the paper transportation path. The delivery roller 25 is disposed so that it can be driven rotationally by a feed motor not shown. A second pressure roller 26 of a specific width is pressed to the delivery roller 25 so that it rotates in conjunction therewith. This second pressure roller 26 is attached to the distal end part of a pressure lever 27 that is attached extending to the back below the vacuum platen 8. The second pressure roller 26 is pressed to the delivery roller 25 as a result of the pressure lever 27 being urged down by a spring force.

The vacuum platen 8, the tension guide 24, the paper feed roller 22, the pressure lever 27, and the second pressure roller 26 are disposed on the access cover 3 side, and move in conjunction with the access cover 3.

The part of the recording medium 10 pulled from the roll paper 9 is conveyed passed the printing position while being held to the platen surface 8*a* of the vacuum platen 8. Content is printed by the inkjet head 16 at the printing position while the carriage 17 travels bidirectionally on the carriage guide shaft 18. After the operation of printing a line widthwise to the recording medium 10 ends, the paper feed roller 22 and delivery roller 25 are driven rotationally and the recording medium 10 is advanced a specific pitch. The next line is then printed. The recording medium 10 is thus printed by the inkjet head 16 while being intermittently advanced a specific pitch.

A fanfold paper insertion unit 31 is disposed at the back side of the head unit frame 15 in the roll paper printer 1 according to this embodiment of the invention. A guide plate mounting unit 32 is disposed to the insertion unit 31, and a paper guide for fanfold paper not shown can be removably attached from the back side. When this paper guide is attached, the transportation path that guides the recording medium 10 from the roll paper compartment 7 side around the tension guide 24 and between the paper feed roller 22 and the first pressure roller 23 is closed, and a transportation path for fanfold paper inserted from the back of the printer is formed, thereby enabling printing on fanfold paper inserted therethrough from the back of the printer.

Recording Paper Transportation Path Structure

The recording paper transportation path structure that feeds recording paper from the nipping part of the paper feed roller 22 and first pressure roller 23 to the platen surface 8*a* of the vacuum platen 8 is described next with reference to FIG. 4 to FIG. 6.

Figure 4A:
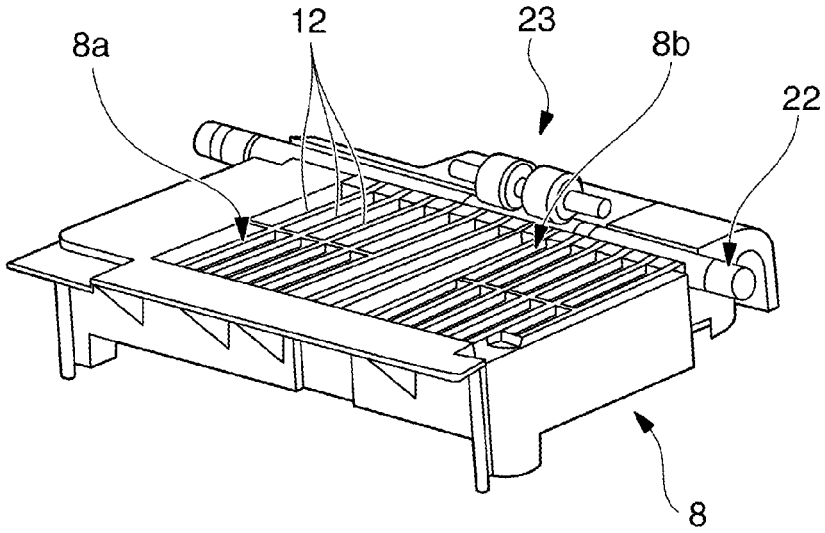
FIG. 4 is an oblique view and a side view of the recording paper transportation path structure.
Figure 4B:
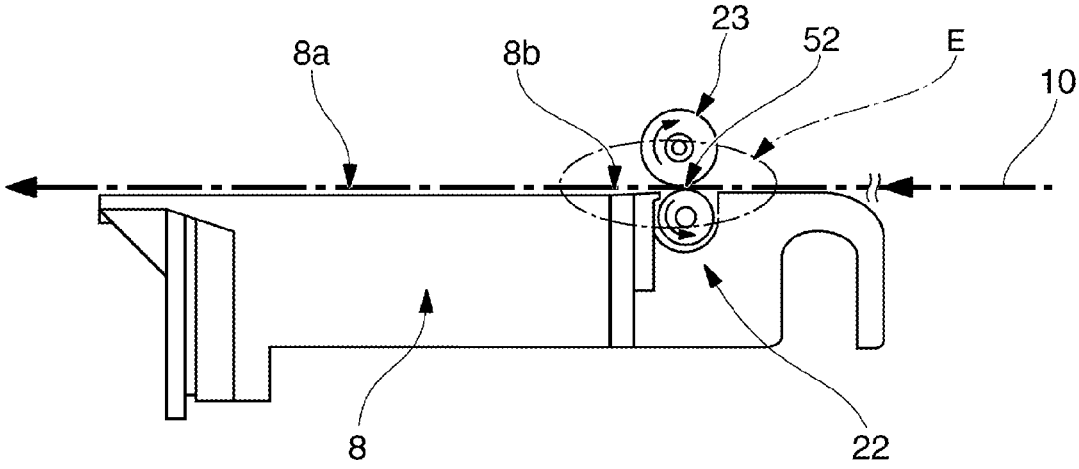

FIG. 4A is an oblique view showing the recording paper transportation path structure, and FIG. 4B is a side view of the same. FIG. 5 is an enlarged view of the part E marked by a dot-dash line in FIG. 4B. FIG. 6 describes the recording paper transportation operation of the recording paper transportation path structure.

Figure 5:
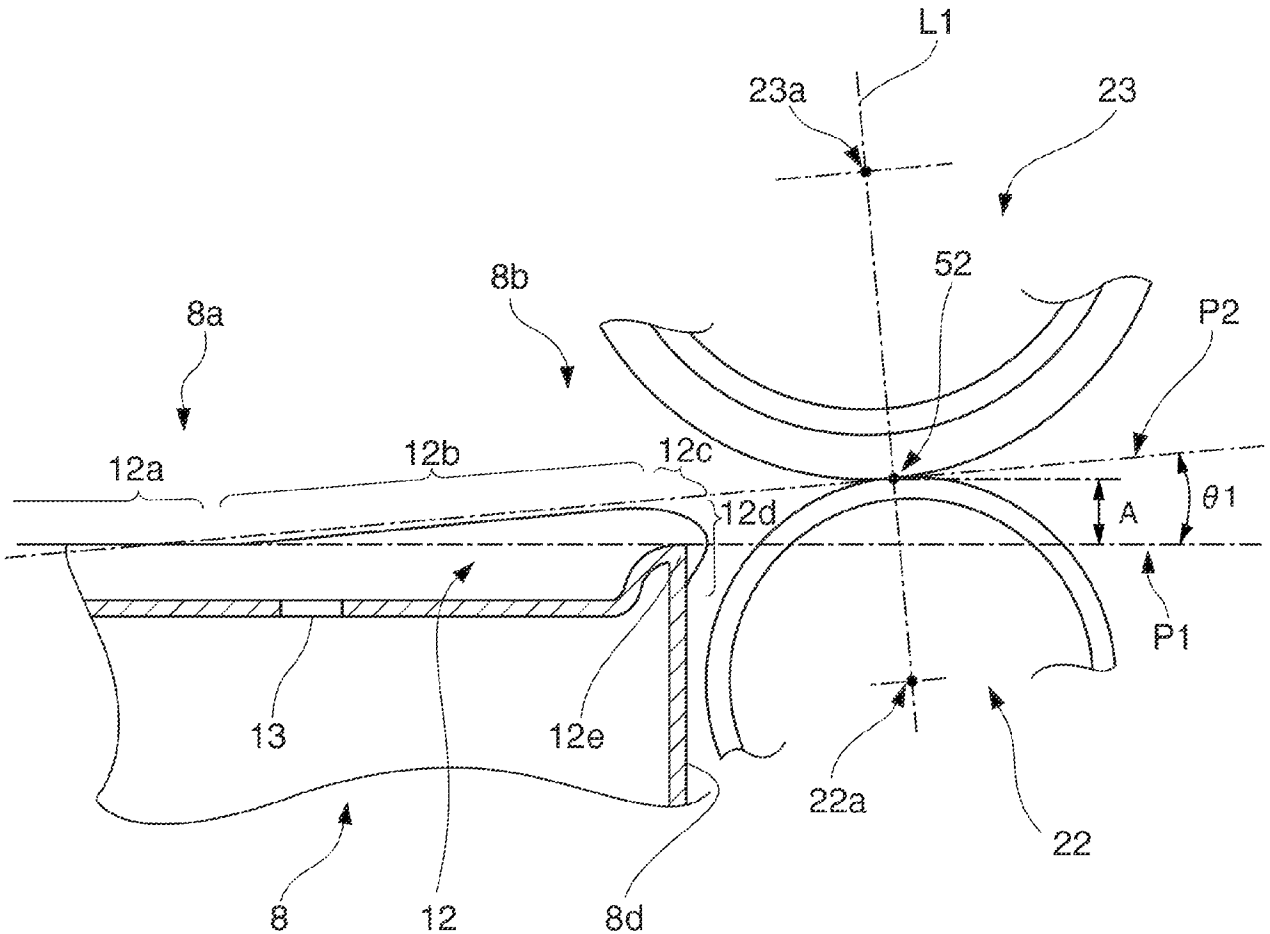
FIG. 5 describes the main parts of the recording paper transportation path structure.
Figure 6:
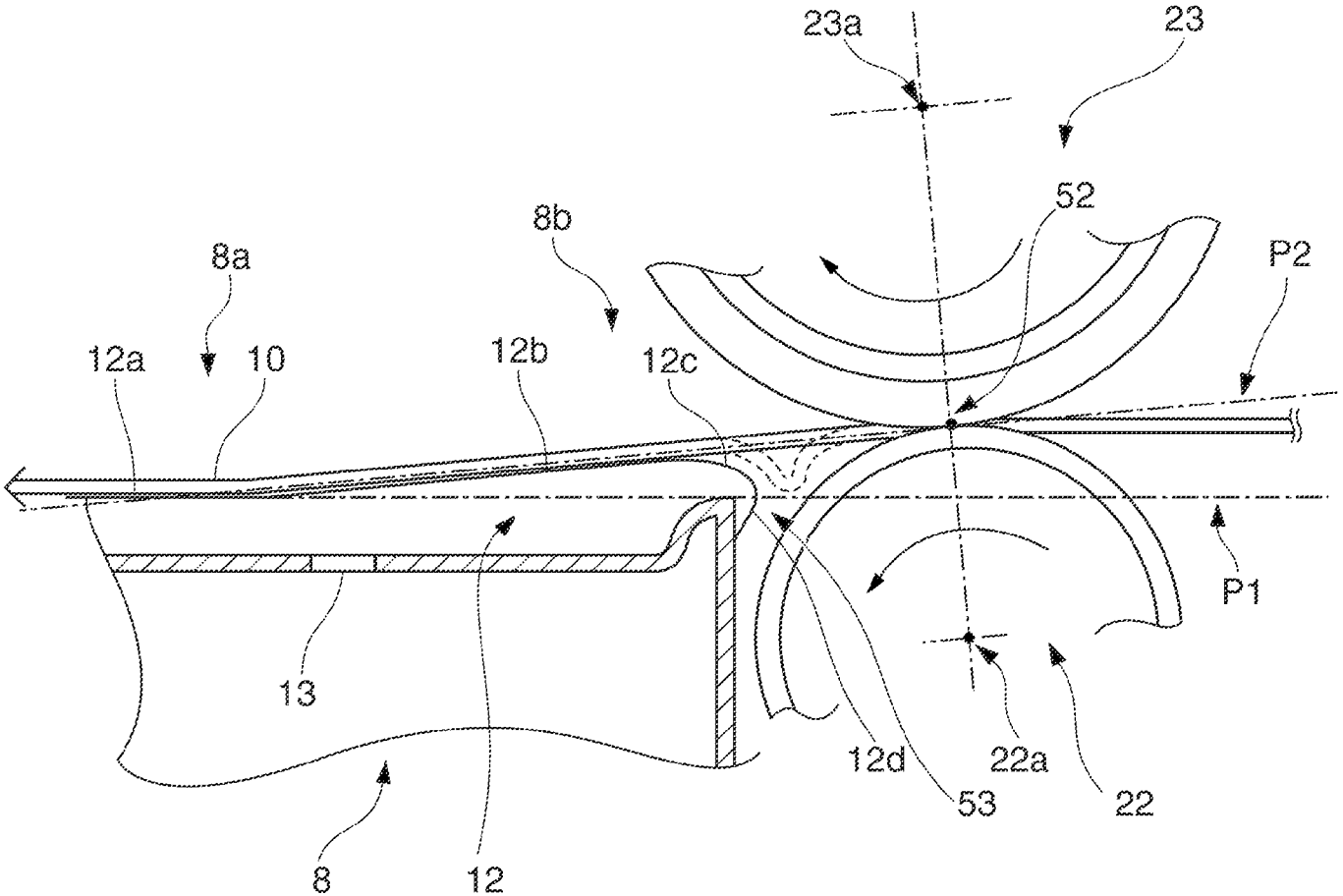
FIG. 6 describes the operating effect of the recording paper transportation path structure.
Figure 7:
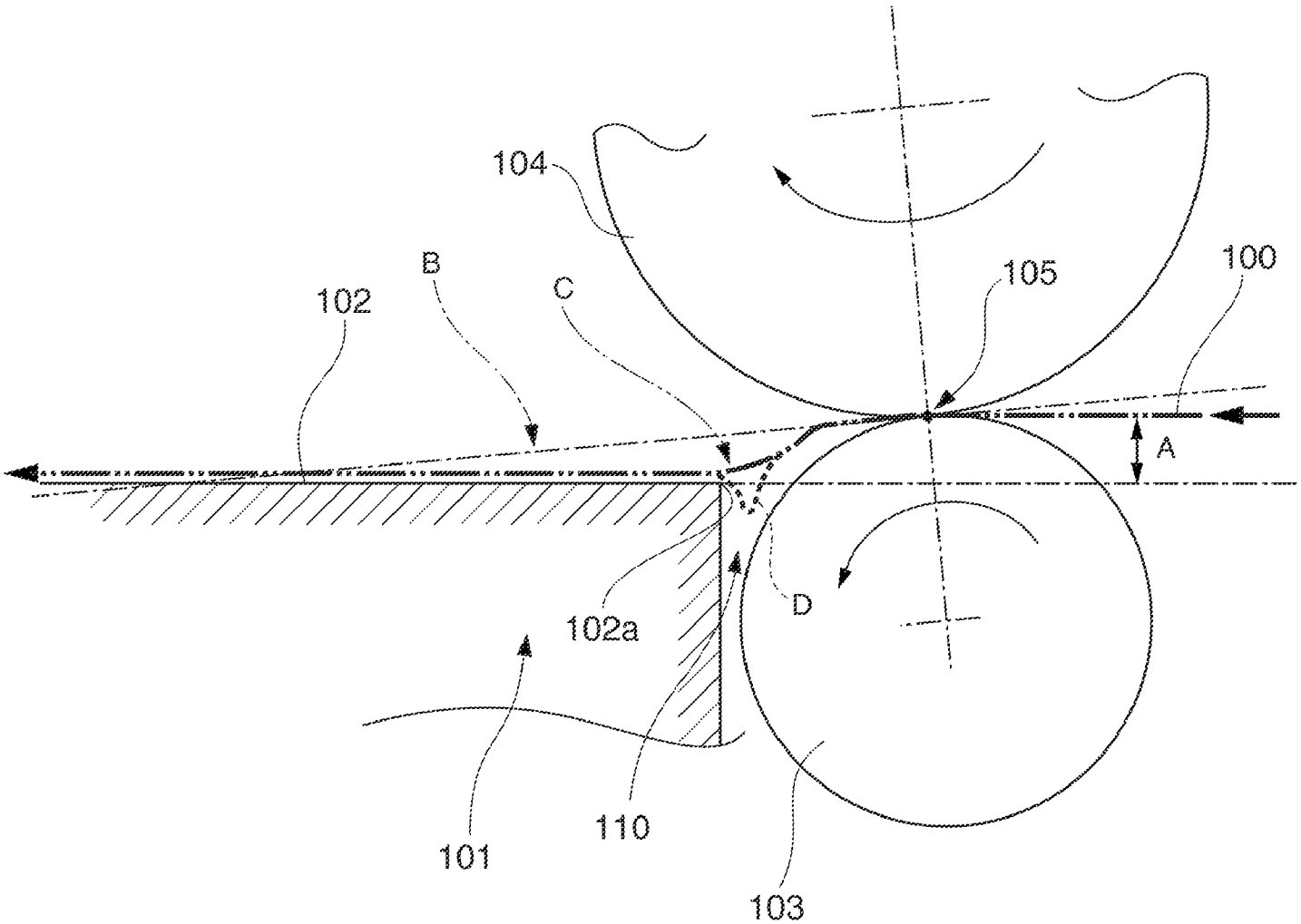
FIG. 7 describes the problem addressed by the invention.

Referring first to FIG. 4 and FIG. 5, the platen surface 8*a* of the vacuum platen 8 is defined by the top surfaces of a plurality of longitudinal ribs 12 that are arrayed at a specific pitch in the paper transportation direction. Except for the upstream end part 8*b* in the paper transportation direction, the platen surface 8*a* is a flat surface that extends widthwise to the printer. The paper feed roller 22 is disposed at a position adjacent to the upstream side of the upstream end part 8*b* of the platen surface 8*a*, and the paper pressure roller 23 is pressed from above to the paper feed roller 22.

As shown in FIG. 5, the nipping part 52 of the paper feed roller 22 and paper pressure roller 23 is at a position offset height A above the horizontal plane P1 at which the platen surface 8*a* is positioned. The paper pressure roller 23 is disposed to a position offset slightly to the front of the printer from the paper feed roller 22, and the line segment L1 connecting the roller centers 22*a* and 23*a* is inclined with the top thereof leaning slightly to the front of the printer. As a result, the feed direction of the recording medium 10 advanced from the nipping part 52, that is, the contact plane P2 of the outside circumference surface of the rollers 22 and 23 passing through the nipping part 52, is an inclined plane that slopes angle 1 from the nipping part 52 to the platen surface 8*a* in a direction approaching the platen surface 8*a*.

Except for the upstream end part 8*b*, the top surface of each longitudinal rib 12 is a horizontal surface 12*a*. At the upstream end part 8*b*, however, the longitudinal ribs 12 rise up to the upstream side (with proximity to the nipping part 52), and an inclined surface part 12*b* contiguous to the horizontal surface 12*a* is formed by this part. This inclined surface part 12*b* is an inclined surface with a slope substantially equal to the incline 1 of the contact plane P2 that is the feed direction of the recording paper from the nipping part 52, and is set to a height not protruding above the contact plane P2.

A part that descends from the top is formed to each of the longitudinal ribs 12, and an up-lifting surface part 12*c* that slopes down contiguously to the inclined surface part 12*b* is formed by this part.

In addition, each longitudinal rib 12 has a protruding rib part 12*e* that protrudes to the front more than the vertical end face 8*d* on the upstream side of the platen surface 8*a*. The distal end surface of the protruding rib part 12*e* is a protruding surface part 12*d* that curves to the vertical end face 8*d* side contiguously to the up-lifting surface part 12*c*.

The recording paper transportation operation of this recording paper transportation path structure is described next with reference to FIG. 6.

The recording medium 10 advanced from the nipping part 52 of the paper feed roller 22 and paper pressure roller 23 is fed along the contact plane P2 towards the platen surface 8*a*. The part of the recording medium 10 fed from the nipping part 52 first rides onto and is guided by the top surface part of the longitudinal rib 12 that defines the upstream end part 8*b* of the platen surface 8*a*. The inclined surface part 12*b* that slopes in the direction of the contact plane P2 is formed at this top surface part, and the recording medium 10 supported by this inclined surface part 12*b* is guided toward the horizontal surface 12*a*.

The recording medium 10 is supported from below by the inclined surface part 12*b* along the feed direction from the nipping part 52. As a result, the recording medium 10 is prevented from sagging down in the gap 53 between the nipping part 52 and the platen surface 8*a*.

The up-lifting surface part 12*c* is formed on the upstream side contiguously to the inclined surface part 12*b*. If the part 10*a* of the recording medium 10 between the nipping part 52 and the platen surface 8*a* droops down, it is supported by the up-lifting surface part 12*c* and lifted up towards the inclined surface part 12*b*. Particularly when the fold (perforation) in fanfold paper, for example, passes thereover, the folded part can easily sag as denoted by the dotted line in the figure. Because this part is supported by the up-lifting surface part 12*c*, the recording medium 10 is guided downstream without sagging greatly.

In addition, a protruding surface part 12*d* that protrudes toward the nipping part 52 side is formed contiguously to the up-lifting surface part 12*c*. The gap 53 between the vertical end face 8*d* on the upstream side of the platen surface 8*a* and the paper feed roller 22 is narrowed by this protruding surface part 12*d*. As a result, the recording medium 10 is prevented from becoming pinched in this gap 53 and causing a paper jam.

Problems such as the part of the recording medium 10 advanced from the nipping part 52 drooping down into the gap 53, the feed precision of the part of the recording medium 10 conveyed over the platen surface 8*a* downstream therefrom decreasing, and print quality dropping therefore do not occur. The recording medium 10 is also prevented from falling into the gap 53 and causing a paper jam.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A recording paper transportation path structure that feeds recording paper through a nipping part of a pair of rollers to a top surface of a vacuum platen disposed opposite a print head with an ink nozzle surface facing down, wherein:

the rollers are disposed so that the nipping part is positioned on a contact plane that inclines to a top surface side and is positioned on a print head side relative to the top surface;

the top surface of the vacuum platen that supports the recording paper has a first surface portion and a second surface portion disposed upstream to the first surface portion in the recording paper transportation direction and that faces up;

the second surface portion that guides the recording paper fed from the nipping part is contiguous to the first surface portion, and is formed to an end part of the top surface on the nipping part side and is an inclined surface that downwardly inclines to the first surface portion; and the second surface portion is a guide surface of a height not protruding upwardly above the contact plane.

2. The recording paper transportation path structure described in claim 1, wherein:

the second surface portion has the inclined surface with an inclination angle following the contact plane.

3. The recording paper transportation path structure described in claim 1, wherein:

a protruding surface part that protrudes to the nipping part side more than an end of the vacuum platen on the nipping part side is formed contiguously to the second surface portion.

4. The recording paper transportation path structure described in claim 3, wherein:

the top surface is defined by top surfaces of a plurality of ribs extending in the recording paper transportation direction;

the rib has a protruding rib part that protrudes to the nipping part side more than the end of the vacuum platen; and the protruding surface part is defined by top surfaces of the protruding rib parts.

5. The recording paper transportation path structure described in claim 1, wherein:

the first surface portion is a horizontal surface; and the pair of rollers are disposed horizontally and pressed together vertically.

6. A printer comprising:

a printer head that has ink nozzle surface facing down;

a pair of rollers that feeds a recording paper;

a vacuum platen disposed opposite the print head that has a top surface and that guides a recording paper from a nipping part of a pair of rollers; wherein:

the rollers are disposed so that the nipping part is positioned to a print head side relative to the top surface and is positioned on a contact plane that downwardly inclines to a top surface side;

the top surface of the vacuum platen that supports the recording paper has a first surface portion and a second surface portion disposed to an upstream side of the first surface in the recording paper transportation direction and that faces up;

the second surface portion that guides the recording paper fed from the nipping part is contiguous to the first surface portion, and is formed to an end part of the top surface on a nipping part side and is an inclined surface that downwardly inclines to the first surface portion; and the second surface portion is a guide surface of a height not protruding upwardly above the contact plane.

7. The printer described in claim 6, wherein:

the print head is an inkjet head; and the vacuum platen opposes the ink nozzle surface of the inkjet head, wherein the recording medium is conveyed past a printing position of the inkjet head while being held to the first surface portion of the vacuum platen.

* * * * *